US011712394B1

(12) United States Patent
Spatorico

(10) Patent No.: US 11,712,394 B1
(45) Date of Patent: Aug. 1, 2023

(54) SHOCK ABSORBING FERRULE FOR ASSISTED AMBULATION

(71) Applicant: Anthony L. Spatorico, Columbia, SC (US)

(72) Inventor: Anthony L. Spatorico, Columbia, SC (US)

( * ) Notice: Subject to any disclaimer, the term of this patent is extended or adjusted under 35 U.S.C. 154(b) by 0 days.

(21) Appl. No.: 18/095,779

(22) Filed: Jan. 11, 2023

(51) Int. Cl.
*A61H 3/02* (2006.01)
*A45B 9/04* (2006.01)

(52) U.S. Cl.
CPC ..... *A61H 3/0277* (2013.01); *A45B 9/04* (2013.01); *A61H 3/0288* (2013.01)

(58) Field of Classification Search
CPC ..... A45B 9/04; A61H 3/0277; A61H 3/0288
See application file for complete search history.

(56) References Cited

U.S. PATENT DOCUMENTS 1,314,193 A * 8/1919 Hipwood ..... A61H 3/0277 135/82
1,340,617 A * 5/1920 Lynde ..... A61H 3/0288 135/86
2,675,014 A * 4/1954 Powers ..... A61H 3/0277 135/82
2,960,095 A 11/1960 Smith, Jr.
3,251,372 A * 5/1966 Smith ..... A45B 9/04 135/86
4,252,138 A 2/1981 Fowler
4,881,564 A * 11/1989 Fetterman ..... A61H 3/0288 135/84
5,699,819 A * 12/1997 Simons ..... A45B 9/04 135/82
6,374,841 B1 * 4/2002 Yamamoto ..... A61H 3/0288 135/84
7,395,829 B2 7/2008 Chapman
8,820,339 B2 9/2014 Goodwin
9,516,933 B2 12/2016 Woodall
9,955,760 B2 3/2018 Chen
10,098,424 B1 11/2018 Husted
10,898,406 B2 1/2021 McAteer
11,173,094 B1 11/2021 McGarvey
11,259,983 B2 * 3/2022 Linge ..... A61H 3/0288
(Continued)

FOREIGN PATENT DOCUMENTS

EP 1435805 A1 7/2004
GB 2341313 A * 3/2000 ..... A45B 9/04
JP H10313921 A 5/1997

*Primary Examiner* — Noah Chandler Hawk
(74) *Attorney, Agent, or Firm* — F. Rhett Brockington

(57) ABSTRACT

A shock absorbing ferrule for a shaft of a crutch, an elbow/forearm crutch, a walker and other devices used during assisted ambulation, wherein the shock absorbing ferrule mitigates impact, potentially reducing injury during their use. The shock absorbing ferrule includes a ferrule having a viscoelastic walled cylindrical socket, which is an annular longitudinal cavity fitted with a shock absorbing assembly. The shock absorbing assembly includes at least one compression spring and a push plate. The compression spring has an outside diameter that is less than the inside diameter of the socket and is seated on the metal distribution washer and under the push plate. The push plate is a metal disk with a smooth perimeter edge having an upper side that is in abutment with an end of the shaft and a lower side that is in abutment with the compression spring.

12 Claims, 5 Drawing Sheets

(56) References Cited

U.S. PATENT DOCUMENTS

| | | | | |
|---|---|---|---|---|
| 2016/0278490 | A1 | 9/2016 | Rieker | |
| 2017/0156459 | A1* | 6/2017 | Chen | A45B 9/04 |
| 2017/0311688 | A1* | 11/2017 | Chen | A61H 3/0288 |
| 2019/0343252 | A1* | 11/2019 | Lee | A45B 9/02 |
| 2022/0095754 | A1* | 3/2022 | Younger | A61H 3/0277 |

* cited by examiner

SHOCK ABSORBING FERRULE FOR ASSISTED AMBULATION

BACKGROUND OF THE INVENTION

1. Field of the Invention

The present invention relates generally to devices to mitigate impact during assisted ambulation, and more specifically to a shock absorbing ferrule with an assembly having at least one compression spring, wherein the at least one compression spring is seated within a socket in the shock absorbing ferrule.

2. Background

Crutches typically have some kind of soft cover to prevent or reduce armpit injury. A condition known as crutch paralysis, or crutch palsy can arise from pressure on nerves in the armpit, or axilla; wherein the brachial plexus in the axilla is damaged from the pressure of a crutch. In these cases the radial is the nerve most frequently implicated; the ulnar nerve suffers next in frequency. See en.wikipedia.org/wiki/Crutch.

Ferrules have been disclosed in the literature as rubber ferrules and ground engaging cup. In U.S. Pat. No. 4,252,138 to Ivan A Fowler teaches "The crutch illustrated includes a main tubular member 1, to which is fitted an elbow support 3 and a boss 9 carrying a hand grip 2. A further tubular member 4 is slidable within the tubular member 1, and is provided with a rubber ferrule on the outer end thereof. Both tubular members consist of aluminum or an aluminum alloy, and the tubular member 4 is urged out of the tubular member 1 by means of a steel spring 6, one end of which bears on a plug 7 inserted in the end of the tubular member 4. The other end of the spring 6 bears on a further plug (not shown) in the tubular member 1. This further plug is held in position within the tubular member 1 by means of a pin 8 passing through the boss 9." There are two springs 22 and 6. The smaller spring 22 is used to reset the steel pawl 15 that engages a rack, and the larger spring 22 is a steel spring that is under compression by the rack, extending from the tubular member 4 to the main tubular member 1.

In U.S. Pat. No. 2,960,095 to F. P Smith Jr. teaches a ground engaging cup 28, in the invention reading on a "Convertible Crane-Crutch.

In U.S. Pat. No. 8,820,339 to David Malcolm Goodwin discloses a Walking Aid, wherein the degree of axial resilience and lateral bendability may be varied widely by appropriate constructional means. These may include the geometry and materials of which the bellows section or the entire end piece is made (for example using a bellows of non-circular cross-section), as well as, for example, the introduction of some form of central compression spring, for example in the form of a standard helical compression spring. However, as noted above, a bellows may be configured as a so-called "gas spring", i.e. a chamber filled or partly filled with a compressible fluid. The spring characteristics differ from that of a standard helical spring, but this can be of advantage in walking aids, giving a reasonable degree of axial movement under light axial loading with increasingly less movement as loading increases. If a gas spring type of bellows device is used, the particular characteristics may be varied by providing means to increase or decrease the internal pressure at rest.

The patent prior art is replete with a variety crutch ferrules of various sizes and stability, but is substantially silent on crutch paralysis, or crutch palsy, which arises from pressure on nerves in the armpit, or axilla and the ulnar nerve. Forearm crutches and elbow crutches are a common assistive mobility device for those with functional impairments. However, repeated loading of the wrist and palmar region and continual hyperextension of the wrist during crutch usage may cause wrist strain, pain, and secondary injuries such as carpal tunnel syndrome. In order to reduce risk of injury, a novel wrist orthosis was developed with the intent of improving wrist posture and reducing/redirecting palmar loads from the carpal tunnel region to the adductor pollicis area. Dominant-hand palmar loads and wrist extension angles of healthy, able-bodied subjects were measured during swing-through crutch-assisted gait to demonstrate the orthosis effectiveness. Results indicate a significant decrease in maximum palmar force, contact area, and wrist extension when using the orthosis. Palmar loads were observed to be redirected toward the adductor pollicis when using an orthosis during crutch-assisted gait. Ultimately, this device was effective in redistributing palmar loads with the potential to reduce pain and risk of carpal tunnel syndrome in long-term crutch users.

SUMMARY OF THE INVENTION

The invention is a shock absorbing ferrule with an assembly of at least one compression spring and a push plate, wherein the at least one compression spring is seated under the push plate within a socket in the shock absorbing ferrule.

A first aspect of the invention is that the shock absorbing ferrule fitted with the assembly provides compression and damping during application of a load, and damping during decompression of the load, therein providing shock absorbance.

A second aspect of the invention is that the shock absorbing ferrule (without the assembly) is comprised of a viscoelastic material. The ferrule has a configuration that precludes most of it from being stretched, for example like a ball or a tire filled with a gaseous medium (which is an omnidirectional medium), wherein a force at one point increases the force at all points, therein causing elastic stretching. The presence of an omnidirectional medium would distribute an increased pressure until it was uniform. But that is not the case with a ferrule, such as a crutch tip. While a crutch tip has a viscoelastic base fitted with a metal distribution plate, the metal distribution plate distributes a load substantially undissipated downward onto a third section. In use, the third section is supported by a surface (nominally the ground). The downward force can be high, with little deformation, except for some bulging. A ferrule has no omnidirectional medium to distribute a downward compressive load to the sides of the third section, and therefore even bulging is limited. Viscoelastic materials can be stretched, but not substantially compressed elastically.

A third aspect of the invention is that the assembly imparts excellent elasticity as it has at least one compression spring that is aligned with the load, and dampened by a push plate that impinges an interior wall of the socket of the shock absorbing ferrule. A shaft imparting a load has a short section of the shaft that is in contact with the elastic interior wall of the socket, and the socket has a diameter that can be stretched and the stretching and friction provide possible mechanisms for damping.

A fourth aspect of the invention is that the shock absorbing ferrule can be sized to fit a variety of devices.

A fifth aspect of the invention is that the shock absorbing ferrule (with the assembly) can provide support to a variety of devices on uneven surfaces, therein reducing rocking of tables and walkers, shock absorption that reduces impact to underarm crutches and to forearm/elbow crutches, and damping of vibration generated by motors.

A final aspect of the invention is that the metal distribution plate of the shock absorbing ferrule distributes the load to a third section, where the third section has a greater volume and a larger lower surface area, therein reducing the force per area of the shock absorbing ferrule as compared to the shaft's force per area, and in some cases to a lower perimeter tread.

These and other aspects and advantages of the present invention will be readily appreciated from the following description of preferred embodiments of the invention and from the accompanying drawings and claims.

BRIEF DESCRIPTION OF THE DRAWINGS

The foregoing invention will become readily apparent by referring to the following descriptions and the appended drawings in which.

DETAILED DESCRIPTION OF THE INVENTION

Figure 1:
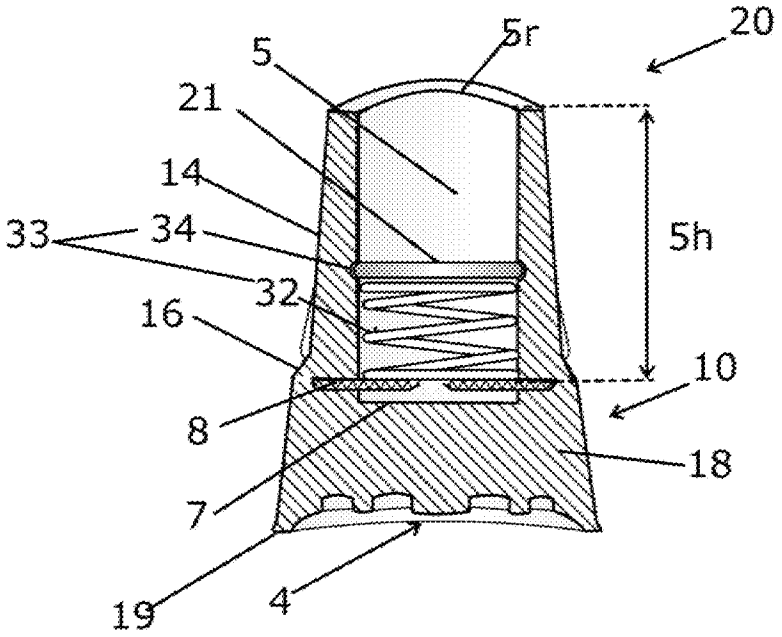
FIG. 1 is a partial cross-sectional side view taken along the section line 1-1 in FIG. 2 of a shock absorbing ferrule.

Illustrative embodiments and exemplary applications are described with reference to the accompanying drawings to disclose the advantageous teachings of the present invention.

Various embodiments of the invention are described more fully hereinafter with reference to the accompanying drawings, in which some, but not all of the embodiments of the invention are shown in the figures. Indeed, these inventions may be embodied in many different forms and should not be construed as limited to the embodiments set forth herein; rather, these embodiments are provided so that this disclosure will satisfy applicable legal requirements. Those having ordinary skill in the art and access to the teachings provided herein will recognize addition.

Examining the final aspect first, the prior art teaches that a crutch shaft is seated in abutment with a metal distribution washer that is embedded in an upper portion of a third section of a crutch tip. The shaft of a crutch (often made of aluminum tubing) typically has an OD diameter ⅞ inches (0.875 inches OD) which is an area of about 0.6 sq. inches. The shaft fills a socket that is about 1.4 inches deep. The ID of the socket is stretched by the shaft from ~0.8 inches to ~⅞ inches. The third section has a diameter of 1.7 inches and a height of ~1 and ¼ inches, with an area of about 2.2 sq. inches. So a shaft load of 100 lbs on 0.6 sq. inches (166.4 lbs/sq. inch) is distributed over 2.2 sq, which is 45.9 lbs. per sq. inch). There is very little elastic deformation of the third section of the ferrule 10, less than 0.05 inches. The third section has minimal function as a compression spring, and there is substantially no shock absorbance of a prior art crutch tip. The shaft load of 100 lbs increases friction of a ground side of the crutch tip to many surfaces, and this friction is augmented by a ground side perimeter tread, which concentrates the force on the third section (45.9 lbs/sq. inch). The ground side perimeter tread functions to improve grip. The ground side perimeter tread is ~⅛ inch wide has an area of about 0.6 sq. inches (165.4 lbs/sq. inch), which is very similar to the socket area of 0.6 sq. inches (166.4 lbs/sq. inch) for a ⅞ inch shaft. One can conclude that the ground side perimeter tread on a bottom of the third section provides a larger footprint, with substantially no shock absorbance or dissipation of force.

The shock absorbing ferrule has a ferrule with a socket that is substantially cylindrical, where the metal distribution plate serves as a floor for the socket with a wall that is viscoelastic. The socket houses an assembly, which includes a push plate and at least one compression spring. The third section is seated on the metal distribution plate and under the push plate. Typically, after the assembly is inserted into the socket of ferrule forming the shock absorbing ferrule an end portion of the shaft is inserted into an upper portion of the socket, therein stretching the upper portion to the shaft's OD diameter, where the end of the shaft is flush with an upper side of the push plate. The push plate has an OD plate diameter that is comparable or larger than the shaft's OD diameter, for example a ⅞" shaft has an OD diameter of ⅞ inch. The push plate, the shaft and the set of at least one compression spring are aligned in the socket. The OD of the push plate can be increased to increase friction and stretching of the wall of the socket. Increasing the stretching increases damping such that following a compression, the recoil of the at least one compression spring is restrained, so recoil isn't as fast. Impingement stretching of the wall of the socket by the push plate appears to impart greater damping than by the shaft, as the wall necks down as the shaft is forced to retracts; whereas if the OD plate diameter of the push plate is greater than the OD diameter of the shaft, the push plate causes outward deformation and then necking inward of the socket wall as the push plate is pushed by the at least one compressed compression spring through the socket. Damping acts as an absorber of a shock absorber, whether the at least one compression spring is being compressed or is recoiling. Hence the term shock absorbing ferrule.

In an exemplary example, the assembly is comprised of a set of concentric compression coil springs arranged to have opposing handed helical coils, where a larger diameter spring (spring 1) has an OD of 0.73 inches, a full height of 0.5 inches, a working height of 0.1 inches, a spring constant 655 lbs/in, a maximum load of 67, and a smaller diameter spring (spring 2) has an OD of 0.4 inches, a full height of 0.5 inches, a working height of 0.13 inches, a spring constant 661 lbs./in., and a maximum load of 55. The concentric compression coil springs function in parallel as a single spring having a maximum load 122 lbs. A shaft load of 100 lbs compresses the springs as follows: Both spring 1 and spring 2 are compressed by about 0.1 inches. Spring 1 provides a force 1 of 49.8 lbs, and Spring 2 provides a force 2 of 50.228 lbs. Spring 2 has a higher spring constant, so it bears a greater load. When compressed, the shaft and the push plate would move ~0.08 inches deeper into the socket, wherein the load of 100 lbs, is accommodated without bottoming out. The third section of the shock absorbing ferrule will still bear about 100 lbs load, but spread out gradually, so impact is reduced, as impact is a function of velocity.

As the set of concentric compression coil springs is seated on the metal distribution plate is being compressed, the shaft and the push plate extend further into the socket, enlarging the diameter of the socket as the shaft and push plate move from a start position further into the socket. In the described example the start point is about 0.5 inches (the uncompressed height of the concentric compression coil springs) from the metal distribution plate, and the shaft and push plate are about 0.94 inches from the socket's rim 5*r* of the socket (1.44 −0.50=0.94 inches). As was taught above, in this example the ID of the socket is stretched by the shaft from ~0.82 inches to ~⅞ inches, and by the push plate having a diameter of ~0.84 inches, which also stretches the socket. The push plate tends to impinge the interior wall of the socket.

The stretching of the socket provides damping, similar to a dash pot or shock absorber.

When the spring force of the set of concentric compression coil springs matches the shaft load, the springs are compressed from a height of about 0.5 inches to less than 0.42 inches (0.5 −0.08=0.42 inches). Two springs were required, as the 100 lbs load exceeds the maximum load of either spring 1 (67 lbs.) or spring 2 (55 lbs.).

Damping is an influence within or upon an oscillatory system that has the effect of reducing or preventing its oscillation. In physical systems, damping is produced by processes that dissipate the energy stored in the oscillation. Examples include viscous drag causing it to slow down in mechanical systems, and absorption. Damping is not based on energy loss. It is not to be confused with friction, which is a dissipative force acting on a system. Friction can cause or be a factor of damping that has the effect of reducing or preventing oscillation. In the context of the instant invention, whether the loss is by friction or viscous drag the term damping is inclusive of both mechanisms, as there is not enough heat generated that performance is deleteriously affected.

Upon removal of the load on the shaft, the set of concentric compression coil springs recoil pushing the shaft and the push plate back to about the start point, which is about 0.5 inches. The shaft and the push plate will produce some frictional resistance as they slide through the socket, therein damping the recoil, but the damping does not significantly extend the time. The recoil can potentially be slowed by employing a larger diameter push plate, as it would generate more viscous drag and dissipative forces in general.

Figure 2:
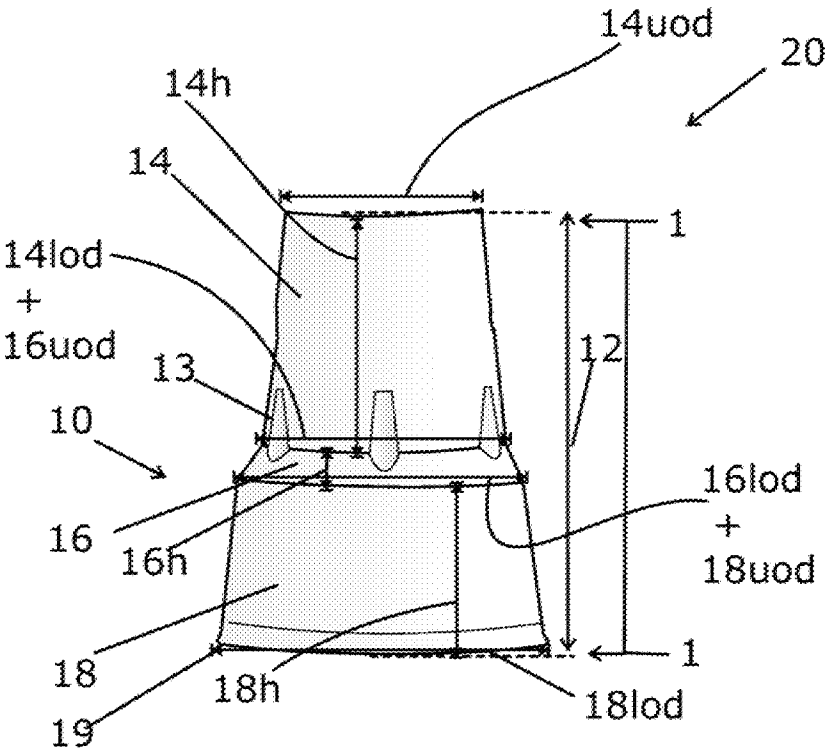
FIG. 2 is a perspective view of the shock absorbing ferrule wherein an assembly of at least one compression spring and a push plate is not visible.

Referring to the drawings, the invented shock absorbing ferrule 20 is a ferrule 19 with an assembly 33, as shown in FIG. 2. From the side perspective view the assembly is not visible. The shock absorbing ferrule 20 is comprised of three sections. The illustrated dimensions of the shock absorbing ferrule can accommodate a ⅞" OD shaft (not shown), and potentially a 1" OD shaft (not shown). The illustrated shock absorbing ferrule 20 has an overall height 12 of ~2.15". A 3" overall height is anticipated to provide for longer compression springs. As illustrated, the ferrule includes an upper frustoconical first section 14 with a first section height 14*h* of ~1.25", a first section upper outer diameter 14*uod* of ~1.24", and a first section lower outer diameter 14*lod* of ~1.44". The second section 16 has a second section height 16*h* of 0.16", an upper outer diameter 16*uod* of ~1.44" and a lower outer diameter 16*lod* of ~1.67". The third section 18 has a third section height 18*h* of ~1.25", an upper outer diameter 18*uod* of ~1.67" and lower outer diameter 18*lod* of ~1.68". There are a plurality of wings 13 that span sections 16 and 14, wherein only three are shown, nominally there are 8±2 wings. There is a perimeter tread 19 located on the lower bottom of the third section 18.

Figure 8:
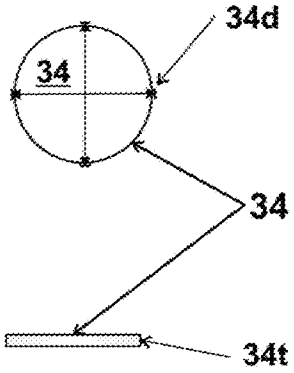
FIG. 8 are a pair of diagrammatic views illustrating a push plate's smooth edges walls, and dimensions for a socket sized to receive a ⅞'s inch shaft.

FIG. 1 is a cross-sectional view of the invented shock absorbing ferrule 20 that enables the assembly 33 to be clearly seen. The at least one spring 32 is selected from coil springs 51, 53, and the wave springs 54, 56 shown in FIG. 7. As shown, concentric pairs 53 (coils), and 56 (waves) are commonly used to increase a resistance to compression, without increasing the height. Concentric pairs are nominally paired to have opposing turns (right turn and left turn coils and waves) to prevent interlacing of coils and waves. The push plate 34 is shown in various views in FIG. 8 to illustrate one of the anticipated versions. Certainly larger and smaller push plates are anticipated.

Figure 5C:
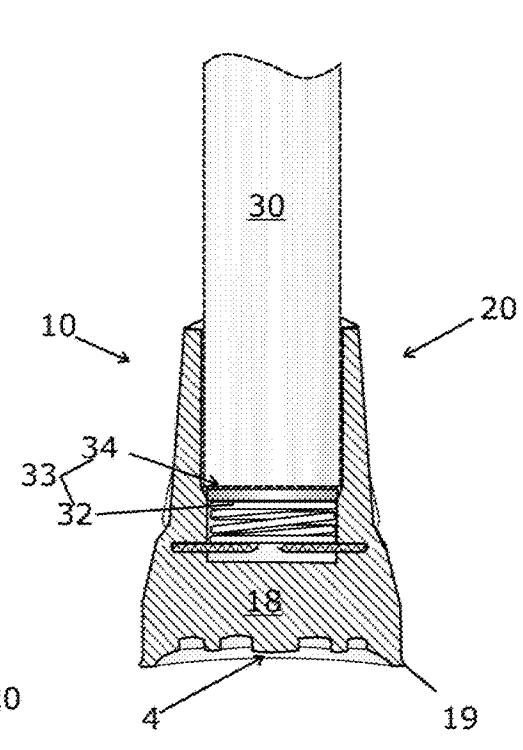
FIG. 5*c* is a partial cross-sectional frontal view of the of the shock absorbing ferrule illustrated in FIG. 3 and taken along sectional line 6-6, wherein an incrementally greater load is carried by the metal distribution washer, wherein the incrementally greater load is sufficiently high to cause bulging of the third section of the shock absorbing ferrule, and on the bottom the perimeter tread is compressed and flared.
Figure 5B:
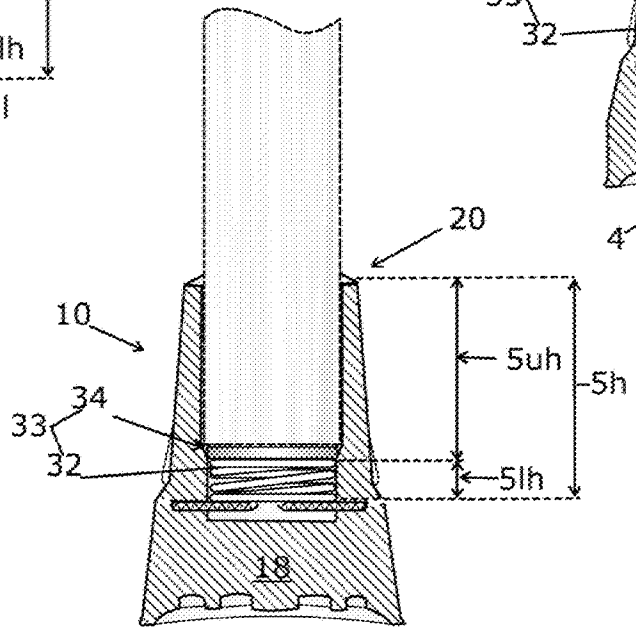
FIG. 5*b* is a partial cross-sectional frontal view of the shock absorbing ferrule illustrated in FIG. 3 and taken along sectional line 6-6, wherein the shaft is now sufficiently loaded to be pushed further into the socket, overcoming any frictional resistance of the shaft expanding the ID diameter of the socket and elasticity of the viscoelastic walls forming the cylindrical socket, and overcoming a frictional resistance of the push plate having an edge that is impinging the viscoelastic walls of the socket, and overcoming the at least one compression spring's resistance to being compressed.
Figure 5A:
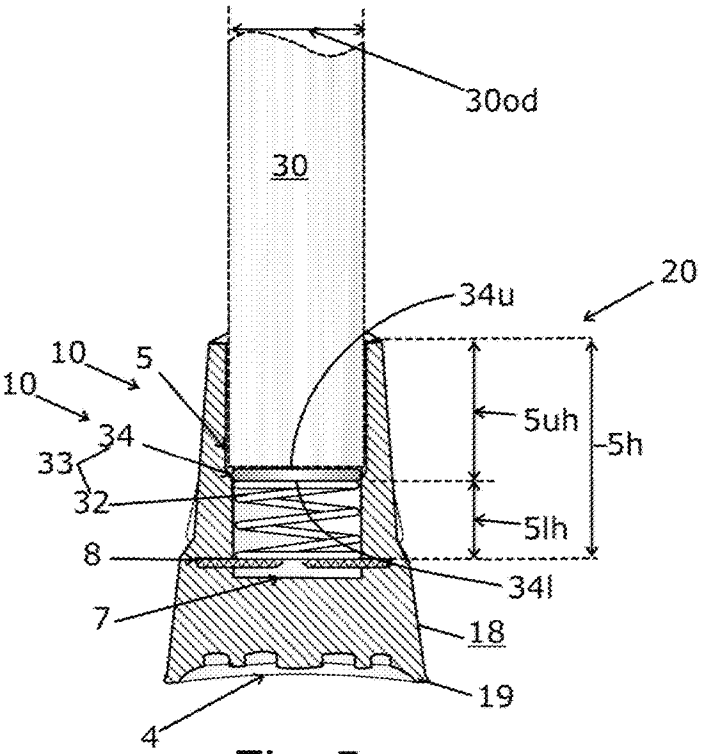
FIG. 5*a* is a partial cross-sectional frontal view of the of the shock absorbing ferrule illustrated in FIG. 3 and taken along sectional line 6-6, wherein the shaft is in the socket at a starting position, which is substantially a static position, as the at least one compression spring is minimally compressed and there is currently no load on the shaft.

The shock absorbing ferrule has a socket 5 that extends through the upper frustoconical first section 14, through the second section 16, terminating in an upper portion 7 of the third section 18. Interiorly the socket is a cylindrical wall. The metal distribution plate 8 serves as a floor for the socket 5. The area beneath the metal distribution plate 8 is a subfloor that is largely an artifact of the manufacturing process that utilizes viscoelastic materials. The socket's overall height 5*h* from the upper side of the metal distribution plate 8 to a socket's rim 5*r* is 1.44" (17/16"). A 3" ferrule has a socket with an overall height 5*h* of ~2.3 inches, which is 62% longer than the illustrated ferrule of 1.44". The at least one compression spring 32 occupies a lower portion 5*lh* of the socket, as shown in FIG. 5*a*, FIGS. 5*b* and 5*c*.

Recall, in the calculation that the concentric springs had a height of about 0.5 inches, leaving 0.94 inches for the shaft. In another example a shaft only required a length of about 0.9 inches for a socket with smooth walls, but a higher Shore A Durometer of 70. It is anticipated that longer springs will need to be accommodated leaving less length in the socket to house the shaft. If the diameter of the socket were made smaller, for example through the use of interior rings (aka ribs) formed in the socket's cylindrical wall, then it is anticipated that longer springs can be employed, as the shock absorbing ferrule socket's diameter is smaller and could grip a shorter end section of the shaft with enough force to retain it, and therefore leaving more length to house longer springs. In general, ferrules that are 3" in height only have a longer first section.

Figure 4:
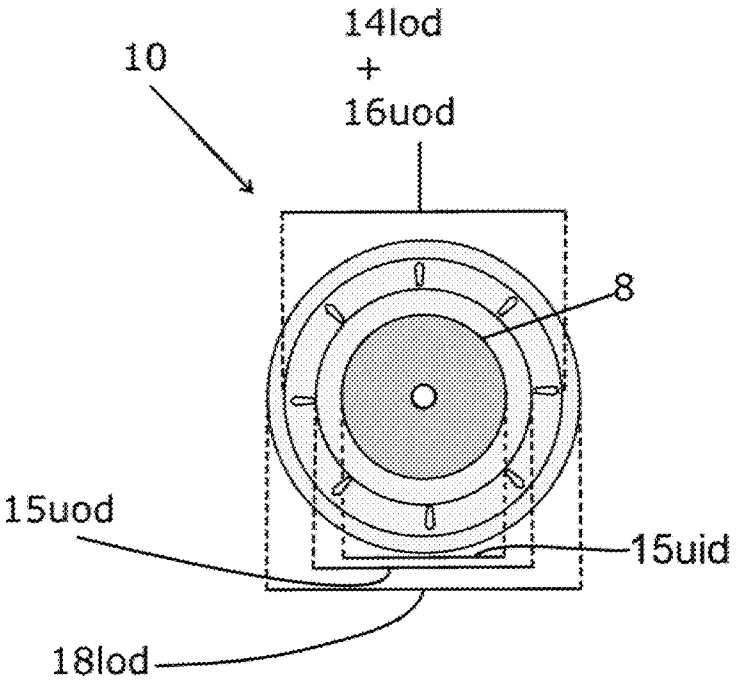
FIG. 4 is an overhead view of the ferrule illustrated in FIG. 2, wherein the ferrule has a metal distribution washer that is embedded in a third section of the ferrule.
Figure 3:
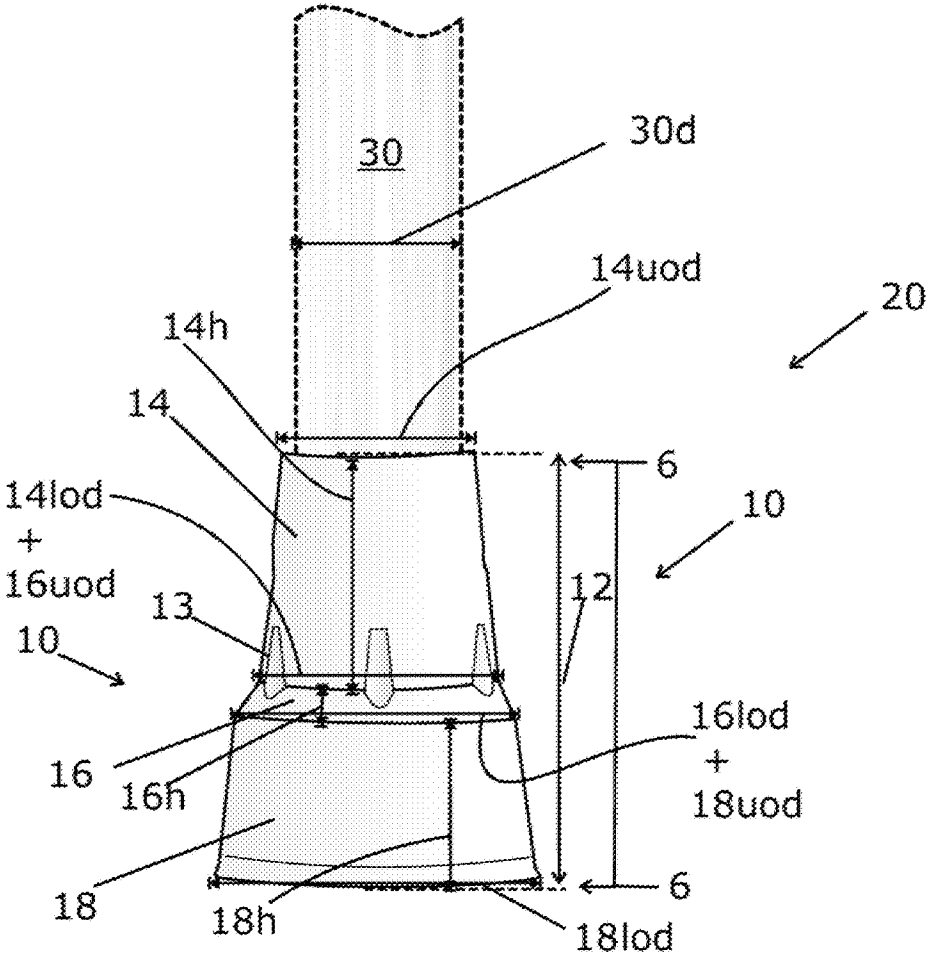
FIG. 3 is a side perspective view of the invented shock absorbing ferrule, wherein the shock absorbing ferrule is with a shaft, wherein dashed lines are used to indicate that the shaft is not an element of the invention.

In FIG. 4, the metal distribution washer 8 is embedded in an upper portion of the third section 18 is illustrated in the overhead view of the ferrule 10. There is no shaft, so the first section upper outer diameter 15*uod* is ~1.14", and the upper inner diameter 15*uid* is ~0.82".

The first section upper outer diameter 14*lod* is 1.14" and the first section lower outer diameter 14*lod* is 1.44". The ferrule is substantially a viscoelastic walled cylindrical socket that is an axial longitudinal cavity that terminates at the metal distribution plate 8 located in a third section. The first section has a first section upper inner diameter 14*uid* of 0.81", and a similar first section lower inner diameter 14*lid*.

Therefore, the first section upper wall thickness is 14*uwt* is 1.14−0.810=0.33" and the first section lower wall thickness is 14*lwt* is 1.440−0.810=0.63. So the closer the push plate and the shaft get to the metal distribution plate 8, the greater will be the resistance. Since it is still cylindrical, the resistance isn't insurmountable, and is typically a limitation of a spring's diameter, but as one can see the wall thickness is nearly double, and will provide greater resistance to stretching and more friction.

The invention further includes configurations wherein the load exceeds the maximum load. FIGS. 5*a*, 5*b* and 5*c* illustrate the operational mechanics of the invention.

In FIG. 5*a* the shock absorbing ferrule 20 has a viscoelastic cylindrical socket 5 with a metal distribution washer 8 that is embedded in the third region 18 of the ferrule 10. The metal distribution washer 8 functions as a floor of the viscoelastic socket 5. The viscoelastic cylindrical socket has an overall length 5*h* of 1.44" (17/16"), with a lower portion 5*lh* that houses the shock absorbing assembly 33, which includes the at least one compression spring 32 seated between the metal distribution washer 8 and an underside 341 of the push plate 34. The lower portion 5*lh* of the viscoelastic socket 5 is not distended, and has a diameter of ~0.82". The illustrated push plate 34 has a diameter of ~0.84, which is comparable to the shaft's outside diameter 20*od* of ⅞" to ~1.0", so the lower height 5*lh* is slightly necked in at the underside 34*l* of the push plate 34. The assembly 33 is not compressed, as there is substantially minimal load on the at least one spring 32. FIG. 5*a* illustrates a start point, wherein the shaft 30 and push plate 34 are at static equilibrium with the spring 32, wherein there is substantially no load on the shaft. At the static equilibrium position at ~0.90 inches of the socket is occupied by the shaft 20 and the push plate 34, while the spring 32 occupies only about 0.5 inches.

Not illustrated is an intermediate load, which is a force sufficient to cause the shaft to move from the start point further into the socket 5 to an intermediate point, wherein the at least one compression spring 32 is partially compressed. At the intermediate load, the shaft can't move until it has a higher load, therein reducing the potential impact of a shaft with a higher load, as impact is a function of velocity. The shorter the distance, the less probable that the impact will be injurious.

In FIG. 5*b* the at least one compression spring 32 of the shock absorbing assembly 33 is fully compressed to a height 5*lh* of ~0.25". The shaft 30 and push plate 34 are now pushed into the socket 5 from the static equilibrium position to a loaded position at ~1.18", where the socket is occupied by the shaft 30 and push plate 34, and the spring occupies 0.25 inches. The shock absorbing ferrule 20 can no longer mitigate impact.

The compression spring, in general, is selected based on its size and compression. FIG. 5*b* illustrates a full threshold force, which is sufficient to cause the shaft to move from the start point to a point wherein the compression spring is completely compressed, wherein only minimal shock absorption is provided.

The illustrated compression wave springs are selected such as they can be compressed to or less than ~0.25". An exemplary spring is a shim wave spring (wsr-75D by Rotor-clip®), which has a diameter of ~0.75" with a free height of ~0.5" and a work height of 0.335". When fully compressed the spring has a compressed height ~0.165". The spring has a max load reported to be ~22 lbs and a spring rate of 133 lbs/in. The wsr-75D can be combined concentrically with a wsm-50F to have a diameter of ~0.50", a free height of ~0.480", a work height of 0.196", a max load of 10 lbs, a spring rate of 35 lbs/in. Taken together the max load is 32 lbs. When fully compressed the pair of springs has a compressed height ~0.165".

Figure 7:
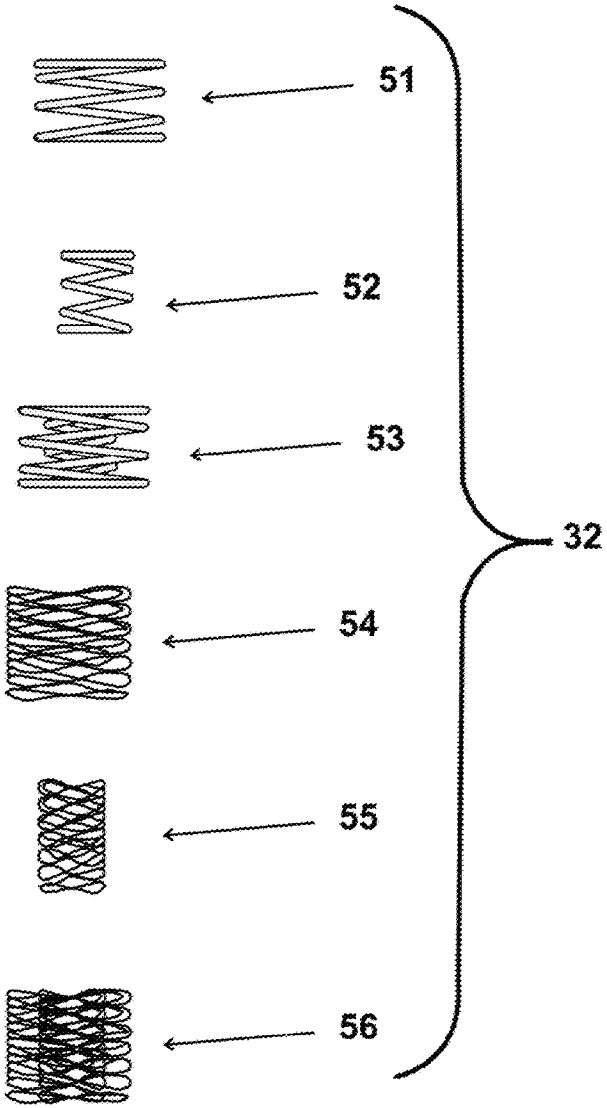
FIG. 7 is a side view of a plurality of compression springs and combinations of springs, wherein it is anticipated that smaller diameter springs can be combined with larger diameter springs to accommodate higher loads.

The wsr-75D spring 54 and the wsm-50F spring 55 are concentric, and taken together is numbered 56 as shown in FIG. 7. Note, that the wave springs coil in opposite direction.

In FIG. 5*c* the load on the concentric compression wave springs has exceeded 32 lbs, and are totally compressed. As illustrated, when this occurs the third section 18 starts to bulge and the treads 4 start to depress, and this is especially the case for the perimeter tread 19.

The shaft 20 retracts when the load is removed. The set of springs pushes the shaft and the push plate back to about the start point, which is about 0.5 inches in the illustrated embodiment. As the shaft and the push plate slide up through the socket they produce some frictional resistance and damping. The speed of recoil does not significantly extend the time it takes to return to the equilibrium start position. As previously stated, the recoil can be slowed by employing a larger diameter push plate, as it would generate more viscous drag and dissipative forces in general.

Vibration and rocking normally occur when a device has more than three legs (aka shafts). The invented shock absorbing ferrule is especially effective for damping vibration and rocking. When a walker or a table vibrates or oscillates because either the load on a leg shifts or the surface is uneven, the shock absorbing ferrule will automatically change according to the change in load, at an intermediate load can the at least one spring can either extend the shock absorbing ferrule or retract it. Whatever adjustment is required.

The springs may be suitable for light loads, such as applications for a variety of devices having a plurality of legs. For example, oscillating devices such as fans, ultrasonic cleaners, paint mixers, and dampening the wobble of uneven legs on a table or a chair, and a diaphragm pump, wherein the load is spread over a plurality of shock absorbing ferrules.

Figure 6:
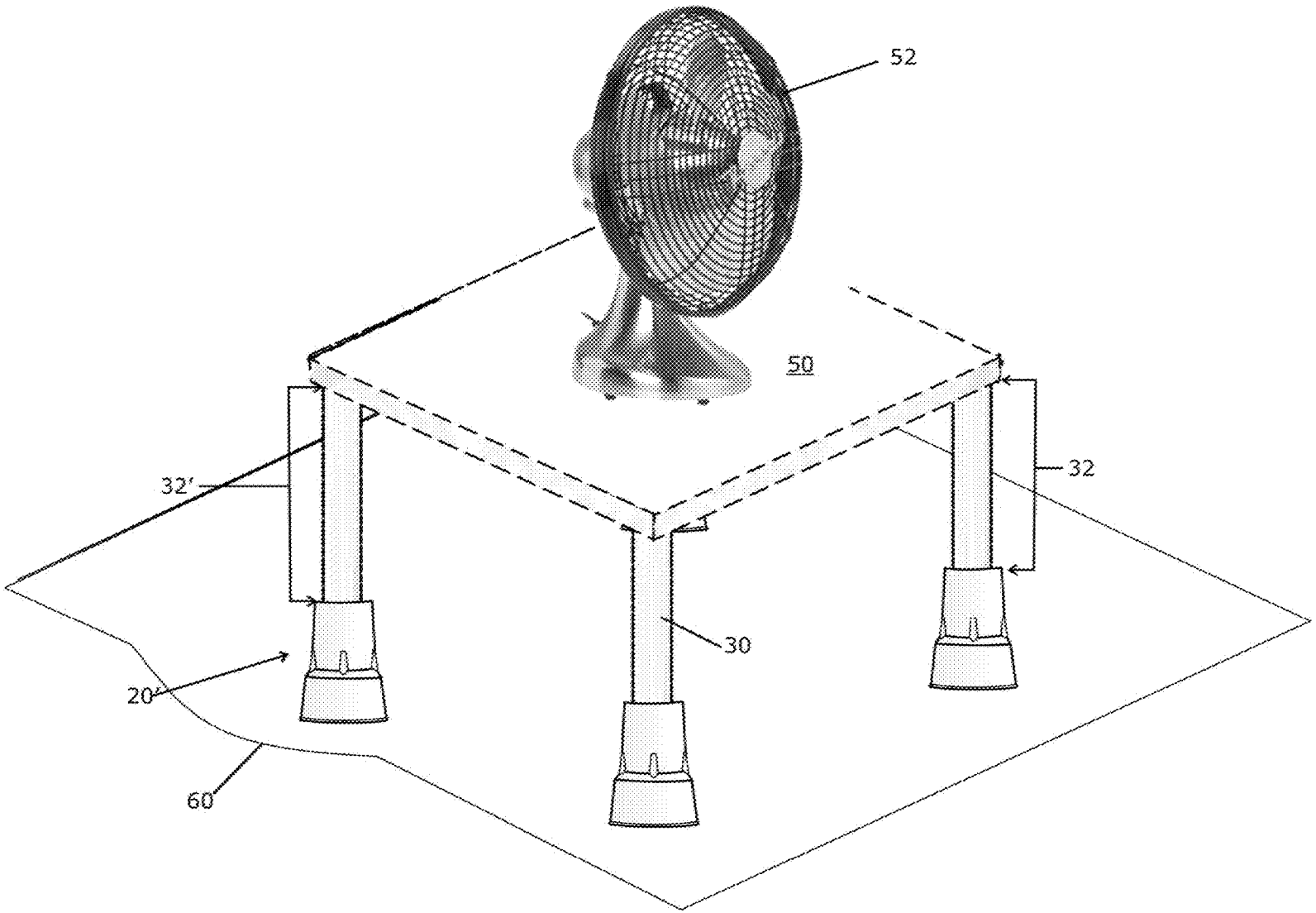
FIG. 6 is a perspective view of an oscillating fan on a table that illustrates how a plurality of shock absorbing ferrules can work together to provide leveling and damping.

FIG. 6 is a perspective view of an oscillating fan 52 on a table 50. FIG. 6 illustrates how a plurality of shock absorbing ferrules 20 can work together to provide leveling and damping, wherein each of the individual shock absorbing ferrule will be compressed based a load the individual shock absorbing ferrule is experiencing. Assume that initially all four of the individual shock absorbing ferrules are partially compressed and have a height of 32. If the Table 50 is moved left into the depression, the shock absorbing ferrule shaft will be applying a lower load, and will be pushed toward the static position, therein lengthening the height to 32', adding stability to the table. The plurality of shock absorbing ferrules dampens the vibration produced by the fan 52.

Similarly In operation, a shock absorbing ferrule reduces the pressure of the crutch on the nerves in the armpit or axilla, therein mitigating crutch paralysis, or crutch palsy. A crutch shaft shortens a small amount to accommodate for a higher load, therein reducing impact.

Reducing impact of a support element such as a underarm crutch, a forearm/elbow crutch or a walker will prevent or mitigate armpit injury and ulnar injury.

The Figures illustrate a specific exemplary embodiment of a shock absorbing ferrule, the viscoelastic walled cylindrical socket, and the operational mechanics of the invention. The exemplary embodiment dimensions are inches, but could be any other unit of measure, as the exemplary embodiment is not limited to a specific size.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A shock absorbing ferrule, wherein said shock absorbing ferrule comprises:

a viscoelastic ferrule comprised of:

a first section having an upper frustoconical shape with a first section height, a first section upper outer diameter, a first section lower outer diameter that is greater than the first section upper outer diameter, and a top opening;

a second section that is contiguous with the first section, having a shorter wider frustoconical shape than the upper frustoconical shape, wherein the first section lower outer diameter functions as a second section upper outer diameter, and a second section lower outer diameter that is greater than the second section upper outer diameter;

a third section that is contiguous with the second section, wherein the second lower outer diameter functions as a third section upper outer diameter, and a third section lower outer diameter that is comparable in diameter to the third section upper diameter therein forming a cylindrical shape having a bottom base and an upper recess, wherein the upper recess is covered by a metal distribution washer that is embedded in the cylindrical shape;

a socket that is an annular axial longitudinal viscoelastic cylindrical cavity that extends from the top opening in the first section, through the second section into the upper recess of the third section of the cylindrical shape, where the metal distribution washer is a floor for the socket;

a shock absorbing assembly seated in the socket, said shock absorbing assembly comprising an at least one compression spring and a push plate, wherein the at least one compression spring has a outside diameter that is less than the inside diameter of the socket and is seated on the metal distribution washer and under the push plate, and wherein the push plate has a smooth perimeter edge, an upper side that is in abutment with an end of a shaft, and a lower side that is in abutment with the at least one compression spring; and wherein the at least one compression spring provides shock absorbance with little loss of energy, and impingement of the push plate and the shaft moving through the viscoelastic socket provides dissipation of energy as evidenced by damping.

2. The shock absorbing ferrule according to claim 1, wherein the shock absorbing ferrule responses to increased force situations, said situations comprising:

a static situation, wherein at a start point there is an initial threshold force which is not sufficient to produce a relevant compression of the at least one compression spring, nor movement of the push plat or shaft an initial threshold force, and therefore is insufficient to cause the shaft to move from a start point;

an intermediate situation, wherein an intermediate threshold force is sufficient to cause the shaft to move from the start point further into the viscoelastic walled cylindrical socket to an intermediate point, therein partially compressing the at least one compression spring, which is effectively providing a counter force that prevents further shortening of the shaft, therein mitigating an impact as the threshold force is incrementally countered and slowed;

a full threshold situation, wherein an overwhelming threshold force is sufficient to cause the shaft to move from the start point or the intermediate point further deeper into the viscoelastic walled cylindrical socket therein completely collapsing the at least one compression spring, wherein the walls of the shock absorbing ferrule are thicker the further into the viscoelastic walled cylindrical socket, and the thicker frustoconical walls impart more resistance to the shaft and push plate, therein mitigating the impact, even when the at least one compression spring is collapsed;

a maximum threshold situation, wherein the force exceeds the full threshold situation, causing the viscoelastic cylindrical third section to bulge and particularly the perimeter tread to bulge, therein providing an incremental mitigation of impact, as the impact is also dissipated by the thicker frustoconical walls, which impart more resistance to the shaft and push plate; and a recoil situation, wherein all force is removed, the recoil of the at least one spring is damped during a recoil back to the initial threshold force, with a removal of force, a rate of decompression of the at least one spring is limited because the shaft and push plate are moving through the viscoelastic socket, which provides a dissipative force that damps oscillation.

3. The shock absorbing ferrule according to claim 1, wherein said shock absorbing ferrule is a crutch tip on an underarm crutch or a forearm/elbow crutch.

4. The shock absorbing ferrule according to claim 1, wherein the shock absorbing ferrule is sized according to the diameter of the shaft.

5. The shock absorbing ferrule according to claim 1, wherein the at least one spring is selected from the group consisting of a helical spring, a concentric pair of helical springs, a wave spring, a concentric pair of wave springs, and combinations thereof.

6. The shock absorbing ferrule according to claim 1, wherein the first section height is lengthened to a greater height, therein lengthening the socket to accommodate at least one spring that is longer.

7. The shock absorbing ferrule according to claim 1, wherein the annular axial longitudinal viscoelastic cylindrical cavity of the socket has ribs.

8. The shock absorbing ferrule according to claim 1, wherein said shock absorbing ferrule is fitted on a walking cane.

9. The shock absorbing ferrule according to claim 1, wherein said shock absorbing ferrule is fitted with at least two shafts/legs of a walker.

10. The shock absorbing ferrule according to claim 9, wherein a first shock absorbing ferrule has at least one first spring and a second shock absorbing ferrule has at least one second spring, wherein the at least one first spring is different than the at least one second spring.

11. The shock absorbing crutch tip according to claim 1, wherein the crutch tip has wings, which reinforce the first section and the second section.

12. A plurality of shock absorbing ferrules, wherein each of the shock absorbing ferrule comprises:

a viscoelastic ferrule comprised of:

a first section having an upper frustoconical shape with a first section height, a first section upper outer diameter, a first section lower outer diameter that is greater than the first section upper outer diameter, and a top opening;

a second section that is contiguous with the first section, having a shorter wider frustoconical shape than the upper frustoconical shape, wherein the first section lower outer diameter functions as a second section upper outer diameter, and a second section lower outer diameter that is greater than the second section upper outer diameter;

a third section that is contiguous with the second section, wherein the second lower outer diameter functions as a third section upper outer diameter, and a third section lower outer diameter that is comparable in diameter to the third section upper diameter therein forming a cylindrical shape having a bottom base and an upper recess, wherein the upper recess is covered by a metal distribution washer that is embedded in the cylindrical shape;

a socket that is an annular axial longitudinal viscoelastic cylindrical cavity that extends from the top opening in the first section, through the second section into the upper recess of the third section of the cylindrical shape, where the metal distribution washer is a floor for the socket;

a shock absorbing assembly seated in the socket, said shock absorbing assembly comprising an at least one compression spring and a push plate, wherein the at least one compression spring has a outside diameter that is less than the inside diameter of the socket and is seated on the metal distribution washer and under the push plate, and wherein the push plate has a smooth perimeter edge, an upper side that is in abutment with an end of a shaft, and a lower side that is in abutment with the at least one compression spring; and wherein the at least one compression spring provides shock absorbance with little loss of energy, and impingement of the push plate and the shaft moving through the viscoelastic socket provides dissipation of energy as evidenced by damping.

* * * * *